US007063320B1

(12) United States Patent
Sheeks et al.

(10) Patent No.: US 7,063,320 B1
(45) Date of Patent: Jun. 20, 2006

(54) PORTABLE MULTIMODE SHUFFLEBOARD GAME APPARATUS, EXERCISE AND STRENGTH MEASUREMENT METHOD

(76) Inventors: Oliver Perry Sheeks, 316 River Run La., Flippin, AR (US) 72634; Sharon R. Sheeks, 316 River Run La., Flippin, AR (US) 72634

( * ) Notice: Subject to any disclaimer, the term of this patent is extended or adjusted under 35 U.S.C. 154(b) by 0 days.

(21) Appl. No.: 10/844,945

(22) Filed: May 13, 2004

(51) Int. Cl.
*A63F 7/00* (2006.01)

(52) U.S. Cl. ..... 273/126 R

(58) Field of Classification Search ..... 273/126 R, 273/126 A, 108, 118 R, 118 A, 119 R, 119 A, 273/287
See application file for complete search history.

(56) References Cited

U.S. PATENT DOCUMENTS

| | | | | | |
|---|---|---|---|---|---|
| 1,601,643 | A * | 9/1926 | Pedrick | 273/108 |
| 2,252,451 | A * | 8/1941 | Anderson | 273/108 |
| 2,260,716 | A * | 10/1941 | Kotler | 273/126 R |
| 2,632,648 | A * | 3/1953 | Neuzerling | 273/108 |
| 3,114,547 | A * | 12/1963 | Joslyn | 273/443 |
| 3,224,777 | A * | 12/1965 | Cirasunda | 273/123 R |
| 3,425,696 | A * | 2/1969 | Dockum | 273/126 R |
| 3,764,144 | A * | 10/1973 | Arthur | 273/126 A |
| 3,934,880 | A * | 1/1976 | Laszlo | 273/108 |
| 4,371,168 | A * | 2/1983 | Dupuis | 273/239 |
| 4,474,374 | A * | 10/1984 | Lewis et al. | 473/14 |
| 4,513,964 | A * | 4/1985 | Gunderson | 273/126 R |
| 5,342,057 | A * | 8/1994 | Sorkoram | 273/239 |
| 5,988,636 | A * | 11/1999 | Kilmer | 273/108.1 |
| 6,419,224 | B1 * | 7/2002 | Tsai | 273/108.1 |

* cited by examiner

*Primary Examiner*—Raleigh W. Chiu
(74) *Attorney, Agent, or Firm*—William L. Chapin

(57) ABSTRACT

A portable game board has a ring-shaped frame containing at least one slide panel marked with indicia used to score trajectories of playing disks slidably launched on the slide panel, which comprises a base panel, an optionally segmented game indicia panel placed on the base panel, or a transparent window slide panel. A pair of base panels having different game indicia are positionable back-to-back within the frame, and selectable by inverting the frame. The board is optionally supportable at an adjustable elevation angle, quantifiably increasing the energy required to propel a disk to distance markers on a panel. An optional platform rotatably supports the game board, facilitating access to board locations by a circle of players. Optionally, an indicia panel contains one or more recessed magnetic slugs; playing disks are provided with one or more ferromagnetic inserts which interact with the slugs to alter the trajectory of a disk.

31 Claims, 8 Drawing Sheets

PORTABLE MULTIMODE SHUFFLEBOARD GAME APPARATUS, EXERCISE AND STRENGTH MEASUREMENT METHOD

BACKGROUND OF THE INVENTION

A. Field of the Invention

The present invention relates to games similar to shuffleboard in which disks are propelled by a player in a sliding motion on a flat playing surface to impart a desired momentum to the disk, scoring points based upon the proximity of the disk trajectory terminus to a target location. More particularly, the invention relates to a portable, multimode shuffleboard game which includes a portable game board that is mountable at an adjustable elevation angle on a support surface to thereby provide a method of exercising upper limbs, hand, wrist, arm, and/or shoulder rotator, and a method of monitoring the relative rehabilitation performance and energy capability of related muscles and joints.

B. Description of Background Art

Shuffleboard is a favorite game for many people, particularly the elderly. Available shuffleboard games typically employ disks which are slidably propelled on a floor surface or a slide board built into a non-portable frame of a heavy table with a relatively massive perimeter frame to accommodate the impact stresses caused by the sliding disks. Despite their basic appeal, shuffleboard games are not widely used in some locations, for the following reasons. The boards for standard shuffleboard games require lubrication for low resistance for proper disk sliding action; cleaning and relubrication is a significant effort. Usually there is only one game layout, which limits appeal to persons who desire variety. Also, space availability is usually limited in senior citizen centers and even more limited in nursing homes. In addition, cost of space and equipment is a sometimes problematic. However, seniors and convalescing persons are often in need of both game-type entertainment and exercise equipment that does not require a lot of standing in its utilization. Therefore, most residents of senior citizen centers, nursing homes and similar venues engage in very sedentary games such as checkers, dominoes, chess or scrabble and as a consequence do not get necessary upper limb exercise. Also, those people needing therapeutic exercise of upper limbs for post-accident therapy or other medical recovery regimens usually are forced to rely on the common dead weight and pulley or other similar types of exercise apparatus which are not challenging to use and therefore not very motivational.

In view of the foregoing considerations, the present inventors conceived of the presently disclosed game and exercise system, which is useable by active and sedentary people alike, provides game-like motivation, portability, ease of equipment storage and set-up on commonly available banquet tables for single or team participation, and cleanability in a medical like environment.

OBJECTS OF THE INVENTION

An object of the present invention is to provide a portable shuffleboard-like multimode game apparatus which includes a game board that has flat playing surface for slidably supporting playing disks, the playing surface being marked with various scoring indicia and bounded by a perimeter frame for confining motion of the playing disks to the playing surface of the game board.

Another object of the invention is to provide a multimode shuffleboard-type game apparatus which includes a game board that has at least one indicia panel marked with various scoring indicia.

Another object of the invention is to provide a multimode shuffleboard-type game apparatus which includes an indicia panel marked with various scoring indicia, and a transparent window panel which has a smooth upper playing surface and is removably positioned over the indicia panel, whereby playing discs may be slidably propelled on the upper playing surface of the window panel towards target locations marked by indicia on the indicia panel and viewable through the window panel.

Another object of the invention is to provide a multimode shuffleboard-type game apparatus which includes a frame having upper and lower peripheral perimeter rings, an upper indicia panel having an outer indicia-marked surface recessed inwardly from an upper surface of the upper perimeter ring, and a lower indicia panel having an outer indicia-marked surface recessed inwardly from a lower surface of the lower perimeter ring, whereby the frame can be inverted to position either the upper or lower indicia panel in a generally horizontal play orientation overlying an object such as a table top used to support the frame.

Another object of the invention is to provide a multimode shuffleboard-type game apparatus which includes a peripheral ring-shaped frame which conformally holds therewithin a base panel on which various one-piece or segmented game panels with different scoring indicia may be interchangeably positioned.

Another object of the invention is to provide a multimode shuffleboard-type game apparatus which has upper and lower indicia panels that are interchangeably overlayable by a transparent window panel which has an upper surface adapted to slidably support playing disks.

Another object of the invention is to provide a shuffleboard-type game apparatus which includes a frame having an elongated, flat playing surface for slidably supporting playing disks propelled thereon, and a rotatable support platform for rotatably supporting the frame on a table top or other supporting object, whereby the game board is rotatable to position the board for play in front of various players seated around the table.

Another object of the invention is to provide a shuffleboard-type game apparatus which includes an elongated ring-shaped frame having retained congruently therewithin a panel having a flat upper playing surface for slidably supporting game disks, the panel having an upper surface recessed below the upper surface of the frame.

Another object of the invention is to provide a shuffleboard-type game apparatus which includes a flat base panel retained congruently within a ring-shaped frame, the base panel preferably consisting of upper and lower panel laminations having different game-scoring indicia marked thereon, whereby the frame may be positioned on a generally horizontal support surface such as a table top with either the upper or lower indicia panels facing upwardly, and whereby game players' disks may be slidably propelled on the upper surface of an indicia panel, or on the upper surface of a transparent window panel removably positioned over the indicia surface.

Another object of the invention is to provide a shuffleboard-type game apparatus which includes a game board that has an elongated flat frame having longitudinally spaced apart, laterally disposed distance indicating lines marked on an upper surface of an indicia panel retained within a peripheral frame, and a fulcrum for supporting the game board with an upper playing surface thereof at an adjustable elevation angle with respect to the horizontal, whereby a playing disk propelled by a person towards a given distance marker requires additional quantifiable energy to be imparted to the disk in addition to the energy required to overcome frictional retarding forces between the disk and playing surface, owing to an increase in elevation of the disk at the end of its trajectory.

Another object of the invention is to provide a shuffleboard-type game apparatus which includes a game board having located in recesses in an upper surface thereof at least one magnetic or ferromagnetic slug which exerts a magnetic force on a disk which also contains a recessed magnetic or ferromagnetic slug and is slid on the board in the vicinity of the magnetic board panel insert.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention contemplates a portable, multimode game apparatus which includes a portable game board that has a playing surface on which circular playing disks are slidably propelled towards scoring locations by human players, in a manner similar to that of a shuffleboard. According to the invention, the game board includes an elongated, preferably rectangularly shaped frame which has a peripheral frame ring, an inner surface of which has an inner peripheral notch which congruently retains therewithin at least one elongated flat panel having scoring indicia marked on an obverse surface thereof. A different pattern of scoring indicia is preferably marked on the reverse side of the panel, enabling a different game to be played by inverting the frame. Preferably, the frame contains two different game panels held in a back-to-back configuration.

The circular plastic playing disks of the game apparatus according to the present invention are manually propelled slidably on a flat playing surface, whereby a person playing the game imparts a desired trajectory to the disk which ideally terminates at one of a plurality of desired scoring positions indicated by indicia on the playing surface. Momentum is imparted to a playing disk to give it a desired trajectory by grasping the disk in the hand, accelerating the disk slidably on a playing surface, with a flick of the wrist, and releasing the disk. Alternatively, momentum may be imparted to a playing disk by larger, "driver", "shooter" or "cue" disk, which is slidably accelerated in the manner described above. In one embodiment of the invention, the upwardly facing surface of an indicia-marked panel serves as the playing surface on which the playing disks are slidably propelled. In another embodiment of the invention, indicia panels, which may be laterally segmented and removable from the frame, are overlain by a continuous transparent window panel, the upper surface of which then comprises the playing surface.

According to another aspect of the invention, the game apparatus includes a "Lazy-Susan" type rotatable support platform for placement on a table top and rotatably supporting the game board, thus enabling access to any end of the game board by game participants seated around a table.

According to another aspect of the invention, a modified indicia panel is provided which has formed in an upper surface thereof a plurality of spaced apart recesses which each hold flushly therewithin a permanent magnet or ferromagnetic slug. With this modified indicia panel, modified player disks are used which have mounted flushly within either or both flat outer parallel surfaces thereof a permanent magnet or ferromagnetic insert slug. Thus, trajectories of game disks propelled in the vicinity of the magnetic inserts in the game panel are altered, in a manner which makes game playing more intriguing.

According to another aspect of the invention, a game panel is provided which includes laterally spaced apart, parallel distance markers which indicate the amount of energy which must be imparted to a sliding disk by a player to reach the marker, thus providing an exercise for and a means of measuring upper arm strength of, for example, a patient recuperating from an injury. Preferably, a fulcrum-type support is provided with this version of the game, the fulcrum being positioned at a selected laterally disposed distance marker to thereby incline the game board at a predetermined elevation angle with respect to the horizontal, and thereby quantifiably increasing the amount of energy which a patient must impart to a propelled disk for the disk to travel to a given destination marker.

BRIEF DESCRIPTION OF THE DRAWINGS

FIG. 10A is an upper plan view of a "shooter", "cue", or "driver disk" for use with the game boards of FIGS. 1 and 2.

FIG. 11A is an upper plan view of a playing disk according to the present invention.

FIG. 11B is a side elevation view of the playing disk of FIG. 11A.

FIG. 13A is an upper plan view of a modified playing disk according to the present invention, which is fitted with a peripheral cushioning band.

DESCRIPTION OF THE PREFERRED EMBODIMENTS

Figures 1, 2:
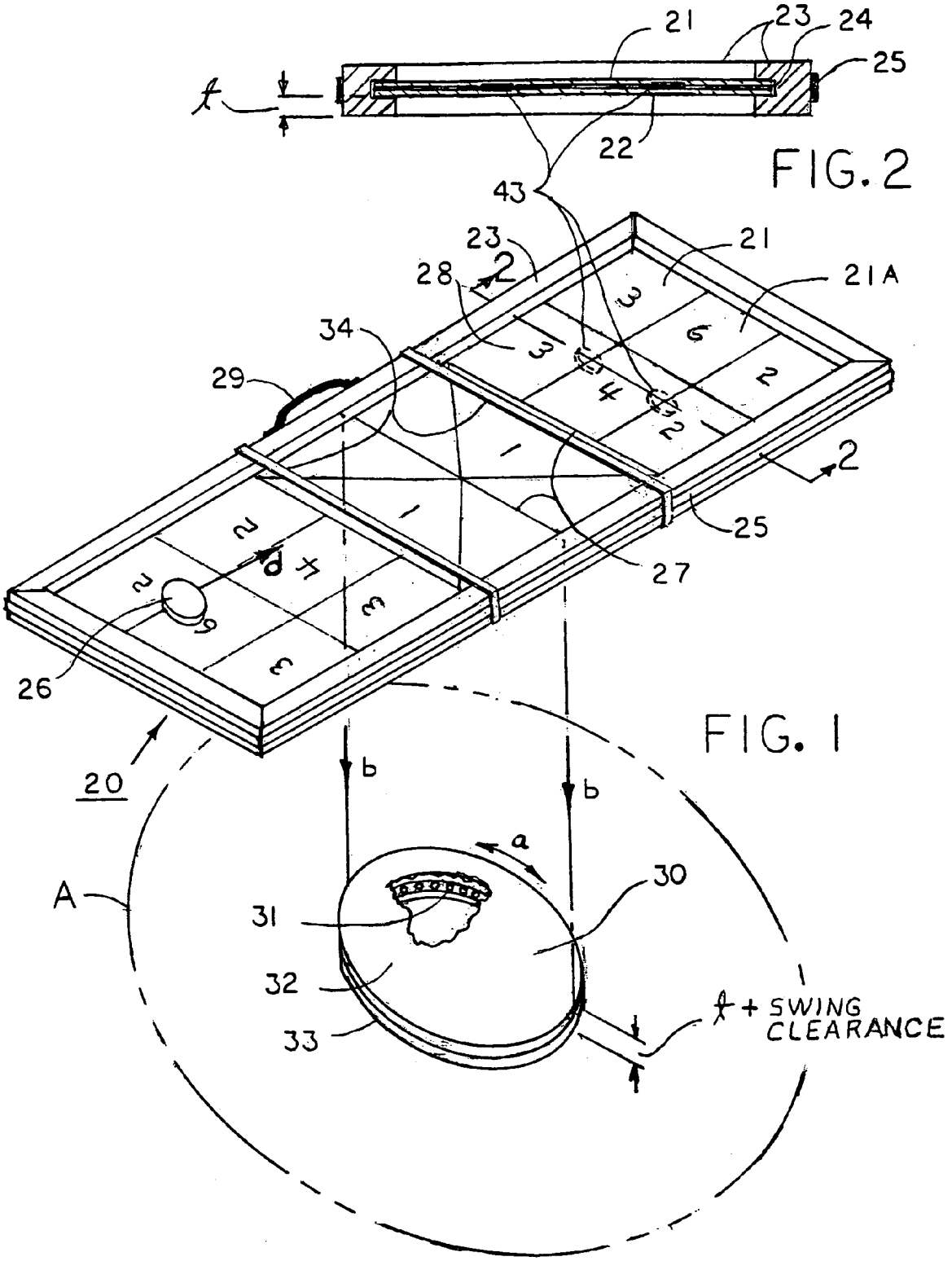
FIG. 1 is a perspective view of a portable multimode shuffleboard-type game apparatus according to the present invention, showing a game board thereof and an optional rotatable platform for the game board.
FIG. 2 is a transverse sectional view of the game board of FIG. 1, taken in the direction indicated by line 2—2 in FIG. 1.

Referring first to FIGS. 1 & 2, a basic embodiment of a portable game board 20 of a multimode game apparatus 19 according to the present invention may be seen to include dual slide boards or panels 21 & 22 secured in a slot 24 formed in the inner vertical wall surface of a rectangular ring-shaped encompassing frame 23, the frame being radially inwardly compressed by a tension band 25. Multimode game apparatus 19 includes a driver disk 26 which may be slid in the direction of vector d on an upper surface 21A of board 21 toward distance markers 27, or to position markers 28 for the purpose of scoring; disks 26 must pass below a pair of transversely disposed, longitudinally spaced apart stretched elastic foul bands 34 which encircle frame 23. Lightweight portable game or exerciser board 20 may be mounted on either a rectangular or circular banquet type table A or B; mounting according to vector b on a circular table A is further benefitted through the adaptation by an optional swivelable or rotatable Lazy Susan-type support platform 30 having cushion top 32 and bottom 33 which allow rotation according to vector a; the game board and platform rotate freely on bearings 31. Moreover, inside dimension t of game board 20 allows swing clearance above the circular table A by the design dimension t+swing clearance.

Further referring to FIG. 1, the illustrated game pattern facilitates playing a game of "Black Jack Shuffleboard" wherein the game pattern numbers on each end add up to 21, as the desired best result in the game of "Black Jack," the Lazy Susan feature of the present invention uniquely facilitating play by multiple players around a circular "Black Jack" table A.

Figure 12C:
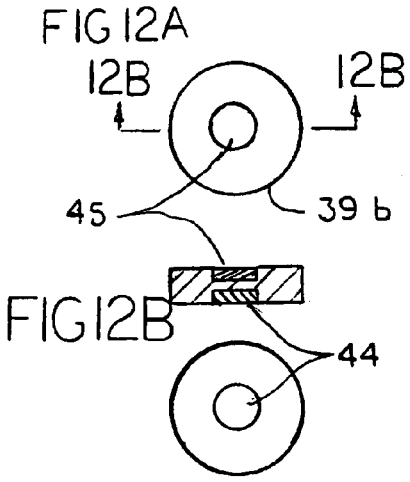
FIG. 12A is an upper plan view of a modified playing disk, according to the present invention, which is provided with one or more ferromagnetic slug inserts recessed within the disk.
FIG. 12B is a longitudinal sectional view of the magnetic playing disk of FIG. 12A, taken in the direction of line 12B—12B in FIG. 12A.
Figure 11C:
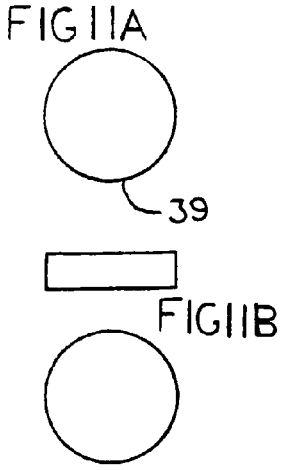
FIG. 11C is a lower plan view of the playing disk of FIG. 11A.
Figure 13B:
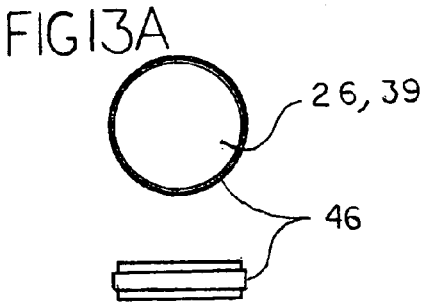
FIG. 13B is a side elevation view of the modified playing disk of FIG. 13A.

Also, further referring to FIGS. 1 and 2, the slide panel 21 may, in some versions, include ferromagnetic inserts 43 (shown in typical placements only) facilitating game features utilizing magnetic interference between the slide panel assembly and a playing disk fitted with one or more ferromagnetic inserts, as shown in FIGS. 12A–12C and described in detail below.

Figure 3:
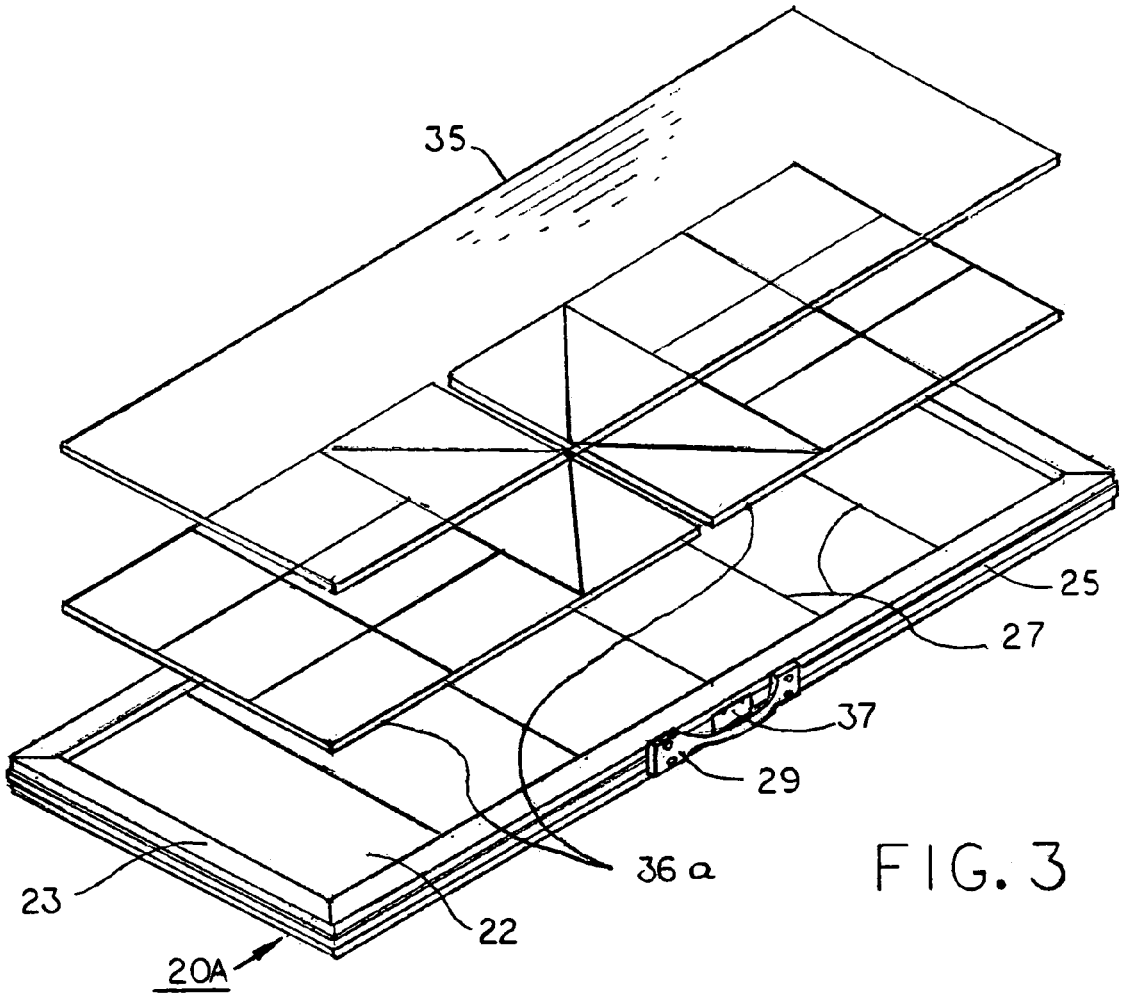
FIG. 3 is a perspective view of a first modification of the game board of FIG. 1, which uses interchangeable indicia panels and an overlying window panel or clear slide sheet.
Figure 4:
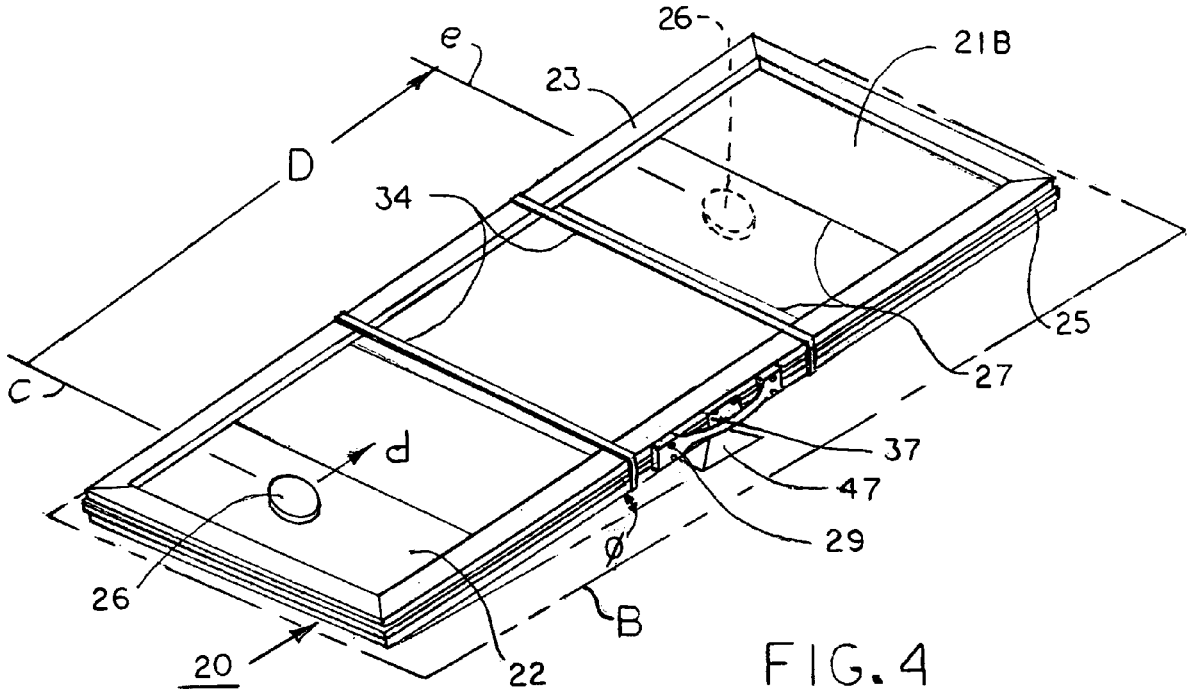
FIG. 4 is a perspective view showing a game board of the type shown in FIGS. 1 and 3, supported at an adjustable elevation angle above a table top or other support surface by a fulcrum.
Figure 5:
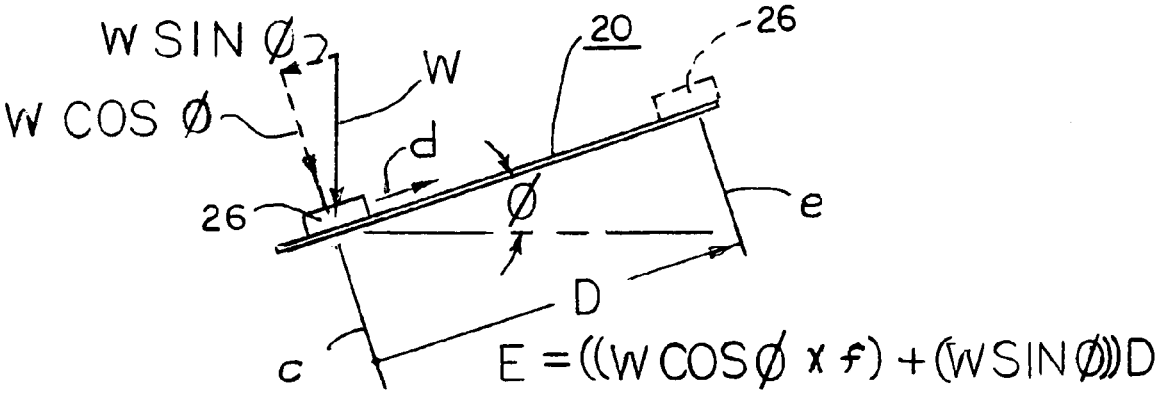
FIG. 5 is a schematic diagram showing resolution of energy imparted to a disk by a player into frictional and elevational components.

Referring to FIG. 3, a modified portable game board 20A according to the present invention includes a multiplicity of different challenging games provided by game layout sheets 36 interchangeably positioned under an added optional clear plastic window or slide sheet 35; this view also showing the prior, FIG. 2, bottom slide board 22; the board having been overturned using handle 29. Lightweight game boards 20, 20A are made strong and impact resistant by tension band 25 and its securing band clip 37. Preferably, frame 23 of game boards 20 and 20A is made of a light-weight, strong material such as oak or other such hardwood. Also, tension band 25 is made of high tensile strength material such as steel which is pre-loaded by securing band clip 37 to a tension of several hundred pounds, thereby making game board 20 light in weight, yet resistant to damage from impact forces exerted by disks 26 propelled on surface 21A of slide board panel 21. Referring to FIGS. 4 & 5, a portable game and exerciser board 20, or 20A is shown mounted on a tilt member support or fulcrum 47 on table B for the purpose of increasing the board's mechanical resistance to motion of a sliding disk 26; the tilt angle θ increases the required energy E to slide disk 26 along vector d between the release point c toward the stopping distance marker e as measured as D; the player/patient's measured, expended, energy E at point of disk release c is a function of the coefficient of sliding friction f, disk weight W, and COS/SIN functions of θ as illustrated in FIG. 5. This arrangement preferably uses a board 21B marked in transversely disposed increment lines 27 representing either inch-pounds or calories of energy expended in the throw. An example calibration of the present invention is as follows: 0.102 calorie (or 3.78 inch pounds) of energy, E, is required to move the drive disk (W=0.262 pounds) a distance D=48 inches for a coefficient of friction of 0.24 and an elevation angle of 3.5 degrees. Tables which indicate the values of E indicative of muscular performance for other values of e and D are optionally and preferably provided with game boards 20, 20A.

Figure 6:
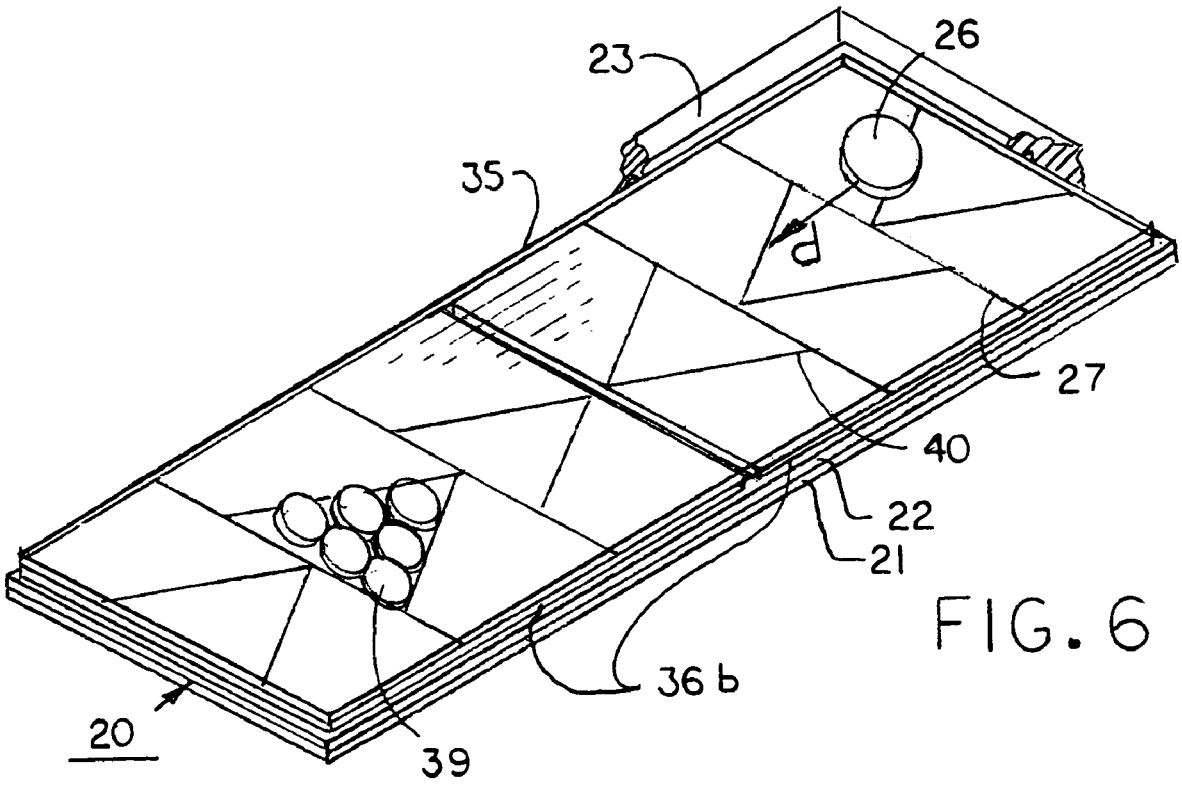
FIG. 6 is a perspective view of a game board of the type shown in FIGS. 1 and 2, which has game indicia panels or insert sheets suitable for playing a "shuffleboard-six" game on the game board.
Figure 7:
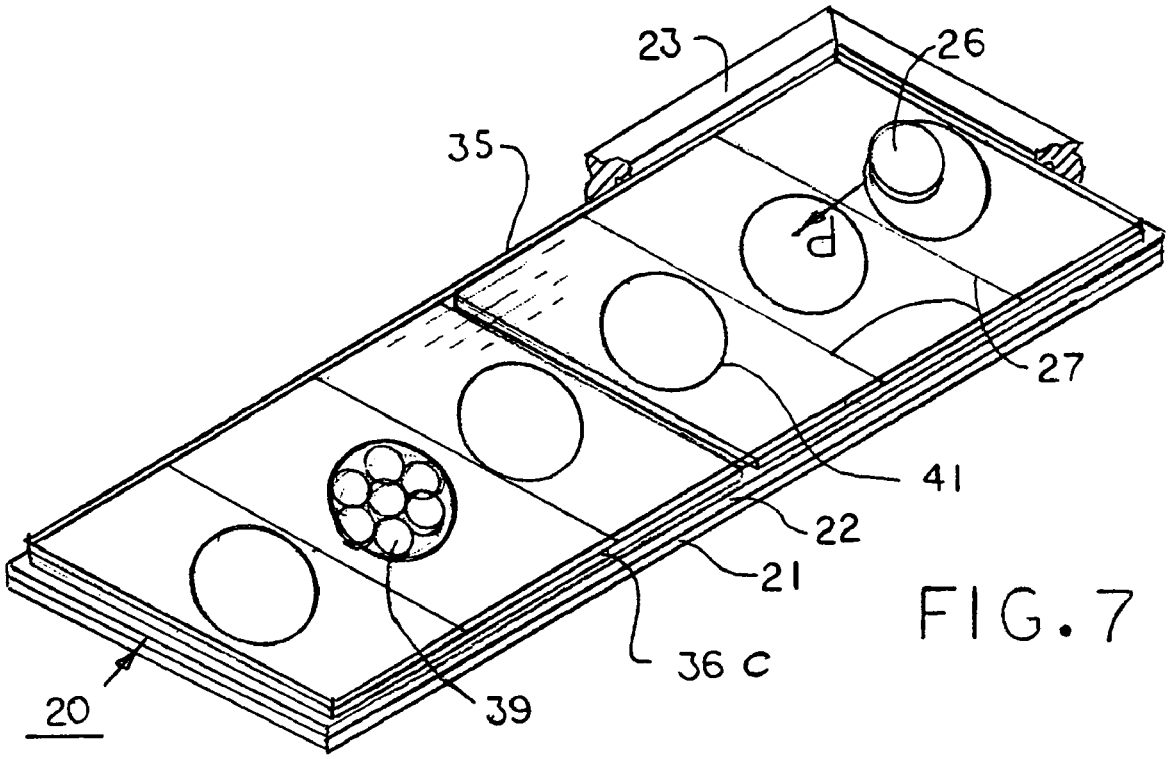
FIG. 7 is a perspective view similar to that of FIG. 6, but showing the game board fitted with panels for playing a "shuffleboard seven" game.
Figure 10B:
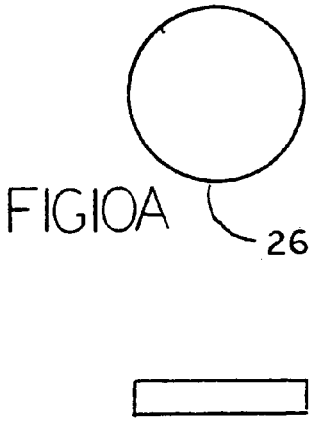
FIG. 10B is a side elevation view of the shooter disk of FIG. 10A.

Referring to FIGS. 6 & 7, two game patterns for the present invention are illustrated as "Shufflebowl Six" 40 and "Shufflebowl Seven" 41, respectively, on game layout sheets 36*b* and 36*c* respectively; wherein larger driver disks 26 are thrown in a sliding motion d toward the smaller target disks 39 with the game-winning purpose of moving all target disks beyond the next marker 27 using the fewest number of drive disks.

Figure 8:
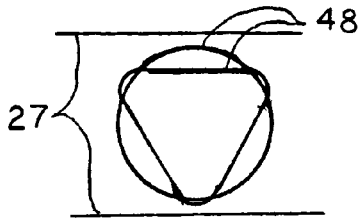
FIG. 8 is an upper plan view of a game indicia pattern suitable for use with the game board arrangement of FIGS. 6 and 7.

Referring to FIG. 8, the layouts of symbols of FIGS. 6 & 7 are combined into one symbol, a triangle in a circle 48; which may be additionally displayed between distance markers 27 on the layout of FIG. 3, board 22.

Figure 9:
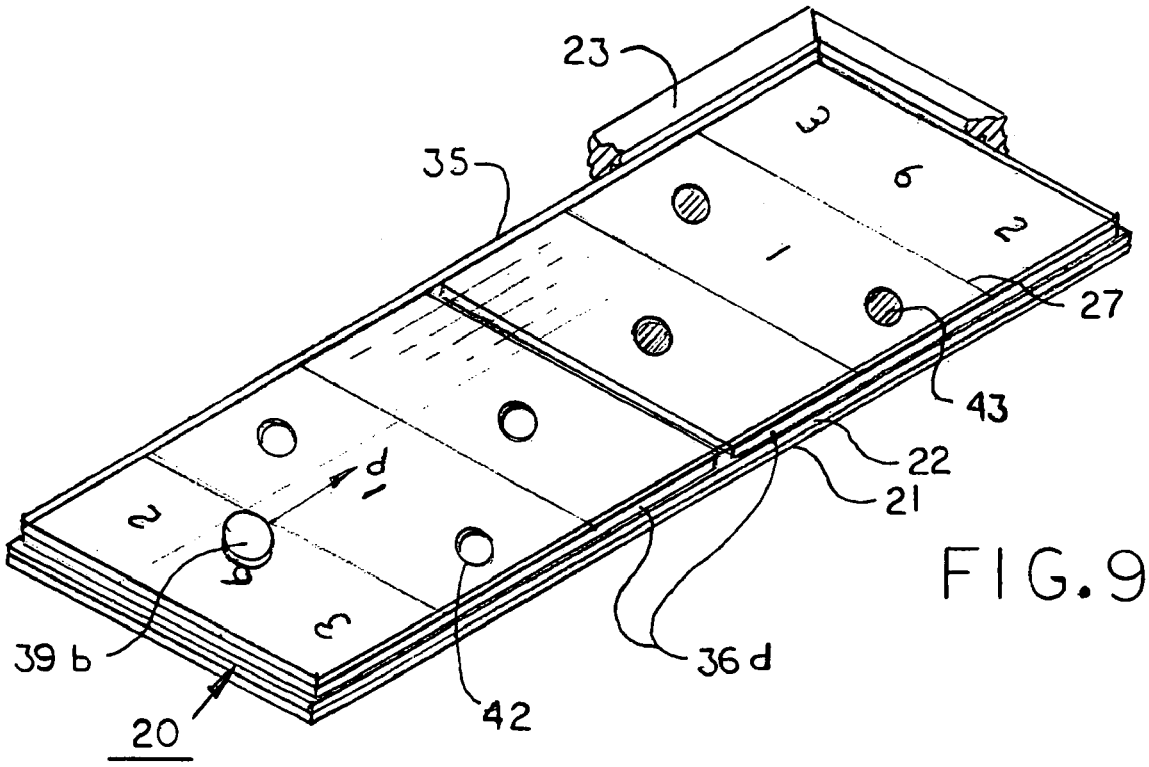
FIG. 9 is a perspective view of a second modification of the game board of FIG. 1, which includes an indicia panel containing a plurality of ferromagnetic slugs recessed below the upper surface of the panel.

FIG. 9 illustrates a game layout using magnetic inserts 43 to influence the path of a sliding disk 39*b* for the game purpose of slowing, diverting, or stopping the disk's motion, yielding a game similar to that of football herein called "Magnetic Shuffleball". Inserts 43, are positioned in holes 42 in game layout sheets or indicia panels 36*d*, with the upper surfaces of the insert flush with or recessed below the upper surface of the panel, and may be made either of magnetic or ferrous material, as further illustrated in FIG. 12. Game positions include 6 for touchdown, 1 for extra point, 2 for conversion, or 3 for field goal; the number of drive disk tries is usually limited to four.

Referring to FIGS. 10, 11, 12 and 13, several types of disks comprising part of the portable game and exerciser board apparatus 19 are illustrated as items 26, driver disk, and item 39, target disk. Target disk 39B is provided with magnetic 44 or alternately, ferrous inserts 45, and disks 26, 39, or 39B are optionally fitted with a noise abatement elastomeric bumper band 46. Disks in an example embodiment of the apparatus consisted of target and driver disks each having a thickness of 1 inch, and a diameter of 2.25 inches or 3.5, respectively. A disk material suited to the desired coefficient of sliding friction is ultra high molecular weight (U.H.M.W.) polyethylene plastic. Slide boards 21/22 are preferably made of ⅛ inch thick melamine, while the clear plastic slide sheet 35 is preferably made of 0.01 to 0.06 inch thick polycarbonate plastic, (or as thin as 0.003 for Mylar) for a resulting composite of frictional coefficient f of about 0.24 or greater for the desired high mechanical resistance required for muscular exercise and game challenge; no added lubrication is required as for other shuffleboards; the U.H.M.W. provides the necessary lubricity to avoid board damage with heavy usage. Another disk material which might have been used was Delrin plastic; however, it has two disadvantages for the present invention which are 1) higher cost and 2) lower coefficient of friction than the desired 0.24 (or greater) because it has about 17 percent Teflon content.

What is claimed is:

1. A game board for slidably supporting playing disks, said game board comprising:

a. a ring-shaped frame having upper and lower surfaces, b. at least a first base panel contained within of said frame, said base panel having a generally flat upper surface recessed below a tangent plane to said upper surface of said frame, said flat upper surface of said base panel being adapted to slidably supporting playing disks, said upper surface of said first base panel having marked thereon a first pattern of game-scoring indicia, and c. a second base panel having a generally flat outer surface marked with a second pattern of game-scoring indicia, said outer surface being recessed inwards from a tangent plane to said lower surface of said frame and adapted to slidably support playing disks, and an inner surface facing an inner surface of said first base panel, whereby said frame is invertible to position said second game-scoring indicia surface in an upwardly facing orientation suitable for slidably supporting game playing disks.

2. The game board of claim 1 wherein said first base panel has a lower surface recessed above a tangent plane to said lower surface of said frame, said lower surface of said base panel being adapted to slidably support playing disks and having marked thereon a second pattern of game-scoring indicia, whereby said frame is invertible to position said second game-scoring indicia surface in an upwardly facing orientation suitable for slidably supporting game playing disks.

3. The game board of claim 1 further including a support platform rotatably supporting said game board.

4. A game board for slidably supporting playing disks, said game board comprising:

a. a ring-shaped frame having upper and lower surfaces, b. at least a first base panel held within said frame, said base panel having a generally flat upper surface recessed below a tangent plane to said upper surface of said frame, said flat upper surface of said base panel being adapted to slidably support playing disks, and c. a transparent slide window removably positionable above said upper surface of said base panel, said slide window having an upper surface adapted to slidably support playing disks.

5. The game board of claim 4 further including at least a first replaceable indicia panel on which is marked game indicia, said indicia panel being replaceably positionable on said base panel beneath said slide window.

6. The game board of claim 5 further including at least a second replaceable indicia panel having a game indicia pattern different from that of said first replaceable indicia panel.

7. The game board of claim 6 wherein at least one of said first and second replaceable indicia panels is further described as being segmented into at least two parts.

8. The game board of claim 5 wherein at least one of said base panel and said replaceable indicia panel is marked with a plurality of transversely disposed distance marker lines which are longitudinally spaced apart from an end of said frame and indicative of how much energy must be imparted to a playing disk to cause said disk to travel from said end to a particular one of said marker lines.

9. An apparatus for exercising arm muscles and measuring the strength thereof comprising the game board of claim 8 and adjustable support means for supporting said board with a distal end thereof elevated at an adjustable angle and height relative to a horizontal support surface for said adjustable support and board.

10. The game board of claim 5 wherein at least one of said base panel and a said replaceable indicia panel is further described as having formed therein at least one magnetic panel region.

11. A game apparatus including in combination the game board of claim 10 and at least one playing disk having at east a first surface adapted to slide on a playing surface of said board, said disk having at least one magnetic disk region which is magnetically interactable with said magnetic panel region to thereby cause a trajectory of said disk on said playing surface to be altered by a magnetic force between said magnetic panel region and said magnetic disk region, when said trajectory is sufficiently close to said claim magnetic panel region.

12. The game apparatus of claim 11 wherein said magnetic panel region is further defined as being a magnetic slug located within a cavity formed in a surface of a first base panel.

13. The game apparatus of claim 11 wherein at least one of said magnetic disk region and said magnetic panel region is permanently magnetized.

14. A game board for slidably supporting playing disks, said game board comprising:

a. a ring-shaped frame having upper and lower surfaces, b. at least a first base panel held within said frame, said base panel having a generally flat upper surface recessed below a tangent plane to said upper surface of said frame, said flat upper surface of said base panel being adapted to slidably supporting playing disks, and c. a tensioning band which compressively encircles an outer peripheral wall surface of said frame.

15. A game board for slidably supporting playing disks, said game board comprising;

a. a polygonal ring-shaped frame having upper and lower surfaces, and an inner peripheral surface disposed perpendicularly to said upper and lower surfaces and having formed therein a polygonal ring-shaped groove, b. at least a first base panel having generally flat and parallel upper and lower surfaces and a peripheral edge wall retained within said groove, and c. a tensioning band which compressively encircles an outer peripheral wall surface of said frame.

16. A game board for slidably supporting playing disks, said game board comprising;

a. a polygonal ring-shaped frame having upper and lower surfaces, and an inner peripheral surface disposed perpendicularly to said upper and lower surfaces and having formed therein a polygonal ring-shaped groove, b. at least a first base panel having generally flat upper and lower surfaces and a peripheral edge wall retained within said groove, said upper surface of said first base panel having marked thereon a first pattern of game scoring indicia, and c. a second base panel having a generally flat outer surface marked with a second pattern of game-scoring indicia, said outer surface being recessed inwards from a tangent plane to said lower surface of said frame and adapted to slidably support playing disks, and an inner surface facing an inner surface of said first base panel, whereby said frame is invertible to position said second game-scoring indicia surface in an upwardly facing orientation suitable for slidably supporting game playing disks.

17. The game board of claim 16 wherein said frame is further defined as having a longitudinally elongated rectangular shape.

18. The game board of claim 16 wherein said first base panel has a lower surface recessed above a tangent plane to said lower surface of said frame, said lower surface of said base panel being adapted to slidably support playing disks and having marked thereon a second pattern of game-scoring indicia, whereby said frame is invertible to position said second game-scoring indicia surface in an upwardly facing orientation suitable for slidably supporting game playing disks.

19. The game board of claim 16 further including at least a first elastic foul band which compressively encircles a transverse dimension of said frame.

20. The game board of claim 19 further including at least a second foul band longitudinally spaced apart from said first foul band.

21. A game board for slidably supporting playing disks, said game board comprising;

a. a polygonal ring-shaped frame having upper and lower surfaces, and an inner peripheral surface disposed perpendicularly to said upper and lower surfaces and having formed therein a polygonal ring-shaped groove, b. at least a first base panel having generally flat upper and lower surfaces and a peripheral edge wall retained within said groove, and c. a transparent slide window removably positionable above said upper surface of said base panel, said slide window having an upper surface adapted to slidably support playing disks.

22. The game board of claim 21 further including at least a first replaceable indicia panel on which is marked game indicia, said indicia panel being replaceably positionable on said base panel beneath said slide window.

23. The game board of claim 22 further including at least a second replaceable indicia panel having a game indicia pattern different from that of said first replaceable indicia panel.

24. The game board of claim 23 wherein at least one of said first and second replaceable indicia panels is further described as being segmented into at least two parts.

25. The game board of claim 22 wherein at least one of said base panel and said replaceable indicia panel is marked with a plurality of transversely disposed distance marker lines which are longitudinally spaced apart from an end of said frame and indicative of how much energy must be imparted to a playing disk to cause said disk to travel from said end to a particular one of said marker lines.

26. An apparatus for exercising arm muscles and measuring the strength thereof comprising the game board of claim 25 and adjustable support means for supporting said board with a distal end thereof elevated at an adjustable angle and height relative to a horizontal support surface for said adjustable support and board.

27. The game board of claim 22 wherein at least one of said base panel and a said replaceable indicia panel is further described as having formed therein at least one cavity adapted to hold therein a slug which has an upper surface which does not protrude above an upper surface of said panel, said slug being of a ferromagnetic material.

28. A game apparatus including in combination the game board of claim 27 and at least one playing disk having at least a first surface adapted to slide on a playing surface of said board, said disk having at least one ferromagnetic insert which is magnetically interactable with said slug to thereby cause a trajectory of said disk on said playing surface to be altered by a magnetic force between said insert and said slug, when said trajectory is sufficiently close to said slug.

29. The game apparatus of claim 28 wherein at least one of said slugs and said insert is permanently magnetized.

30. A game apparatus including in combination the game board of claim 21 and at least one playing disk adapted to slide on said playing surface of said base panel, said disk having therein at least one magnetic disk region which is magnetically interactable with said magnetic panel region to thereby cause a trajectory of said disk on said playing surface to be altered by magnetic force between said magnetic panel region and said magnetic disk region, when said regions are sufficiently close.

31. The game apparatus of claim 30 wherein at last one of said magnetic panel region and said magnetic disk region is permanently magnetized.

* * * * *